United States Patent [19]

Itahana et al.

[11] Patent Number: 4,886,425

[45] Date of Patent: Dec. 12, 1989

[54] CAPACITY CONTROL DEVICE OF SCROLL-TYPE FLUID COMPRESSOR

[75] Inventors: Tsutomu Itahana; Tetsuo Ono, both of Nagoya City; Tamio Sugimoto, Nishikasugai, all of Japan

[73] Assignee: Mitsubishi Jukogyo Kabushiki Kaisha, Tokyo, Japan

[21] Appl. No.: 173,712

[22] Filed: Mar. 25, 1988

[30] Foreign Application Priority Data

Mar. 26, 1987 [JP] Japan ..... 62-43418[U]

[51] Int. Cl.[4] ..... F04B 49/02

[52] U.S. Cl. ..... 417/309; 417/310

[58] Field of Search ..... 417/310, 309, 440; 418/55 R; 137/569; 251/61.5

[56] References Cited

U.S. PATENT DOCUMENTS

| | | | |
|---|---|---|---|
| 2,433,302 | 12/1947 | Synder | 137/569 |
| 2,683,418 | 7/1954 | Smith Jr. | 417/309 |
| 2,963,219 | 12/1960 | Palmqvist et al. | 417/309 |
| 4,222,712 | 9/1980 | Huber et al. | 417/310 X |
| 4,544,333 | 10/1985 | Hirano | 417/309 X |

FOREIGN PATENT DOCUMENTS

| | | |
|---|---|---|
| 57-110189 | 7/1982 | Japan . |
| 60-75796 | 4/1985 | Japan . |

*Primary Examiner*—Carlton R. Croyle
*Assistant Examiner*—Leonard P. Walnoha
*Attorney, Agent, or Firm*—McGlew & Tuttle

[57] ABSTRACT

A capacity control device controls an amount of fluid bypassed from a compression chamber formed between contacts of a stationary and revolving spiral elements into a suction chamber by an actuator. The capacity control device provides a feedback mechanism in which a relation between a suction pressure of the compressor and a pressure of actuating the actuator is a function of the first degree and controls the suction pressure to be constant. A capacity control amount of the compressor can be determined only by the suction pressure of the compressor independent of other variation factors. Accordingly, the minimum suction pressure can be restricted strictly and frost control can be attained by the compressor itself.

5 Claims, 5 Drawing Sheets

CAPACITY CONTROL DEVICE OF SCROLL-TYPE FLUID COMPRESSOR

FIELD OF THE INVENTION AND RELATED ART STATEMENT

The present invention relates to a bypass-type capacity control device of a scroll-type fluid machine, and more particularly to a capacity control device of a scroll-type fluid compressor.

Referring to FIGS. 3(A) and (B) showing the configuration of a scroll-type compressor provided with a conventional capacity control mechanism, the compressor 1 comprises a housing 10 composed of a front end plate 11 and a cuplike case 12. The front end plate 11 is formed with a central hole in which a bearing 13 is disposed. A main shaft 14 is rotatably supported by the bearing 13 through the central hole. A stationary scroll member 15 and a revolving scroll member 16 are disposed within the housing 10. The stationary scroll member 15 includes a side plate 151 and a spiral element 152 mounted on the inner surface of the side plate 151 which is fixedly mounted to the cuplike case 12. The revolving scroll member 16 includes a side plate 161 and a spiral element 162 mounted on the inner surface of the side plate 161 and having the same configuration as that of the spiral element 152. The revolving scroll member 16 is engaged with the stationary scroll member 15 so that the spiral element 162 of the element 16 is shifted by an angle of 180 degrees with respect to the spiral element 152 of the element 15. Accordingly, enclosed chambers 251, 252 and 253 are formed between both the scroll members. The revolving scroll member 16 is coupled with a drive mechanism 6 and a self-rotation checking mechanism 7 and revolves in solar-orbital motion on a predetermined circular orbit with rotation of a main shaft 14. Thus, when the revolving scroll member 16 revolves in solar-orbital motion on the predetermined circular orbit with the rotation of the main shaft 14, line contact portions between both the spiral elements 152 and 162 are moved toward the center of the spiral along the surfaces of the spiral elements 152 and 162. Consequently, the chambers 251 and 252 formed between both the scroll members 15 and 16 by the engagement thereof are also moved toward the center of the spiral while the capacities of the chambers are reduced gradually. Fluid flowing into a suction chamber 18 (18*a* and 18*b*) from an external hydraulic circuit through a suction port 26 is introduced into the chambers 251 and 252 through an outer peripheral opening of the spiral formed of both the spiral elements 152 and 162 and compressed. The fluid is exhausted from the center chamber 253 through a penetration opening 154 formed in the side plate 151 of the stationary scroll member 15 into a delivery chamber 19 and then flows out through a delivery port 22 into the external hydraulic circuit.

When the scroll-type compressor is used for a compressor of a car cooler, the drive power of an engine is transmitted to a main shaft 14 of the compressor 1 through a belt and a pulley 5 of a clutch. Accordingly, the cooling capability of the car cooler is substantially linearly increased in proportion to a rotational number of the engine.

The increased work of the compressor 1 reduces the driving efficiency of the automobile, or the excess cooling power cools the automobile unnecessarily. In order to solve such problems, there are provided two bypass holes 30*a* and 30*b* of the identical diameter formed in the side plate 151 of the stationary scroll member 15 and having openings formed in opposing relationship with the two chambers 251 and 252, respectively, the holes 30*a* and 30*b* being formed at positions in the side plate 151 in which the openings of the holes are closed at the same time by an outer end portion of the spiral element 162 of the revolving scroll member 16. Disposed outside of the side plate 151 are actuators 32*a* and 32*b* which open and close the two bypass holes 30*a* and 30*b*. Thus, in the fully loaded state, high-pressure gas in the delivery chamber 19 is led to rear sides of the actuators 32*a* and 32*b* through a control valve 34 disposed behind the actuators 32*a* and 32*b* so that the actuators 32*a* and 32*b* are moved leftward to close the bypass holes 30*a* and 30*b*, while in the unloaded state, gas having a pressure varying from a low pressure to a high pressure is led to the rear sides of the actuators 32*a* and 32*b* through the control valve 34 so that the actuators 32*a* and 32*b* are moved rightward by springs 35*a* and 35*b* to communicate with through openings 42*a* and 42*b*.

The through openings 42*a* and 42*b* communicate with the suction chamber 18 through passages 46*a* and 46*b* formed in the inner periphery of the housing 10.

The rightward movement of the actuators 32*a* and 32*b* is determined by the pressure at the rear sides thereof and the actuators 32*a* and 32*b* are moved more rightward as the pressure is reduced. Thus, there is provided a mechanism, that is, a capacity control mechanism which changes the open area of the through openings 42*a* and 42*b* by the movement of the actuators to control a spill amount of gas in the course of compression.

FIG. 4 shows in detail the control valve 34 shown in FIG. 3(A). The control valve 34 comprises a bellows 301 in which gas such as nitrogen having a constant pressure is contained and including a compression spring provided therein and a three way type valve 304. Numeral 303 denotes a cavity for applying the pressure from the through opening 42*b* to the periphery of the bellows 301, numeral 305 denotes a retainer for the bellows 301, and numeral 306 denotes a retaining ring. The three way type valve 304 is connected with the through opening 42*b*, the delivery chamber 19 and the actuators 32*a* and 32*b*. Operation of the control valve 34 is illustrated in FIG. 5.

When the pressure of the through opening 42*b* (equal to the suction pressure and hereinafter referred as to LP) is low, the three way type valve 304 closes the valve for the delivery chamber 19 by the bellows 301. Accordingly, an actuating pressure of the actuators 32*a* and 32*b* (hereinafter referred to as AP) is equal to the LP. At this time, gas does not flow through the three way type valve. This state continues to the point indicated by 40A of FIG. 5. When the LP becomes larger than that at the point 40A and is between the pressures at the points 40A and 40B, the three way type valve 304 opens the valves for the delivery chamber 19 and the through opening 42*b*. At the same time, the open areas of both the valves are adjusted proportionally by the LP, the inner pressure in the bellows 301 and the resilience of the compression spring 302. Accordingly, the flow rate of gas and the AP change as shown in FIG. 5. In general, a difference between the pressures at the point 40A and 40B is about 0.0294 MPa {0.3 kgf/cm$^2$}. Since the three way type valve 304 closes the valve for the through opening 42*b* at the point 40B, the AP is equal to an HP (which is the pressure in the delivery chamber 19) and this condition of AP=HP is maintained over the LP at the point 40B. Consequently, as described above, the position or movement of the actuators 32*a* and 32*b* is controlled linearly in the range from the fully opened or full admission position to the fully closed position.

However, the above-mentioned conventional control mechanism has two drawbacks as follows:

(1) The control valve 34 detects the LP and determines the position of the three way type valve 304 as described above. However, the relation between the LP and AP changes depending on the variation of the pressure HP of the delivery chamber 19 determined by the balance of the cooling load and the capability of the car cooler. As shown in FIG. 6, for example, the LP-AP characteristic shown by broken line in the case of high HP varies as shown by solid line and one-dot chain line as the HP is reduced. Therefore, the position of the actuators 32*a* and 32*b* (bypass amount) determined by the springs 35*a* and 35*b*, the pressure in the enclosed chambers at the bypass holes 30*a* and 30*b* and the AP is varied. The actuating pressure AP in which the actuators 32*a* and 32*b* which control the bypass area formed by the through openings 42*a* and 42*b* of the actuators 32*a* and 32*b* are fully closed and fully opened is determined with the following restriction. The actuating pressure AP at the fully closed point must be larger than the force produced by a sum of the compression force of the springs 35*a* and 35*b* at the fully closed point, the pressure in the enclosed chamber at the bypass holes 30*a* and 30*b* and a sliding resistance of the actuators 32*a* and 32*b*. The actuating pressure AP at the fully opened or full admission point must be smaller than a difference between a sum of the compression force of the springs 35*a* and 35*b* at the fully closed point and the pressure in the enclosed chamber at the bypass holes 30*a* and 30*b* (equal to LP) and the sliding resistance of the actuators 32*a* and 32*b*.

The pressures AP at the fully closed and fully opened or full admission state are exemplified by 50B and 50A of FIG. 6, respectively. The sliding resistance of the actuators 32*a* and 32*b* is unstable and varies widely. It is necessary to take into consideration variations in the characteristics of the springs 35*a* and 35*b*. Accordingly, since it is necessary to determine the fully open or full admission point 50A with margin, the AP is generally larger than the LP as shown in FIG. 6.

As apparent from FIG. 6, the LP for fully opening and closing the actuators 32*a* and 32*b* varies largely in response to the variation of the HP.

Accordingly, heretofore, the LP to be controlled varies due to the variation of the HP.

(2) Generally, the capacity control of the rotary type compressor is of the bypass type structurally and the bypass flow rate is usually controlled by the actuators 32*a* and 32*b* as shown in FIG. 3. The rear space of the actuators formed between the actuators 32*a* and 32*b* and the cylinder is small due to miniaturization of the compressor itself and is closed. Accordingly, oil is usually collected in the rear space.

The position of the actuators 32*a* and 32*b*, that is, a determination factor of the capacity control amount is determined by the balance of the capability of the compressor 1 and the refrigerant system and the thermal load. For example, when the rotational number of the compressor 1 is suddenly varied and the LP is also suddenly changed, the position of the actuators 32*a* and 32*b* that is, the balance point after change, can not be determined until feedback operation is effected from the refrigerant system.

However, as described above, the space for controlling the actuators 32*a* and 32*b* is small and accordingly the actuators respond to variation of the LP immediately, In general, since the proportional zone (difference between 40A and 40B) of control shown in FIG. 6 is narrow and 0.0294 MPa, the actuators 32*a* and 32*b* are changed to the fully closed point or the fully opened or full admission point, resulting in lack of stability.

As described above, the conventional mechanism has a drawback that the suction pressure LP to be controlled is largely varied and it is difficult to attain stable control.

OBJECT AND SUMMARY OF THE INVENTION

An object of the present invention is to solve the above-described problems in the prior art and an object of the present invention is to provide a capacity control device of a compressor which can determine a capacity control amount only by a suction pressure of the compressor and can attain stable control.

In order to achieve the above object, a configuration of the present invention is as follows. The capacity control device of a scroll-type fluid compressor including a stationary spiral element and a revolving spiral element having a substantially identical configuration and fitted to each other, a center of the revolving spiral element being revolved in solar-orbital motion along a circumference around a center of the stationary spiral element so that fluid is sucked, compressed and delivered and an actuator which controls an amount of fluid bypassed from a compression chamber formed between contacts of both the spiral elements into a suction chamber, is characterized in that a feedback mechanism in which a relation between a suction pressure of the compressor and a pressure of actuating the actuator is a linear function or a function of the first degree is provided therein to control so that the suction pressure is constant.

In the present invention, the feedback mechanism is provided in a control valve. The relation between the suction pressure and the actuating pressure of the actuator is characteristically expressed by a linear equation or an equation of the first degree, and the suction pressure and the bypass amount, that is, the capacity control rate can be determined uniquely. Accordingly, the capacity control amount can be determined only by the suction pressure and stable control can be attained.

According to the present invention, the capacity control amount of the compressor can be determined only by the suction pressure of the compressor independent of other variation factors. Accordingly, the minimum suction pressure can be restricted strictly and frost control can be made by the compressor itself. Even if the space to be controlled is narrow, the stable control can be attained and the compressor can be formed in compact and lightly as a whole.

DETAILED DESCRIPTION OF A PREFERRED EMBODIMENT

Figure 1:
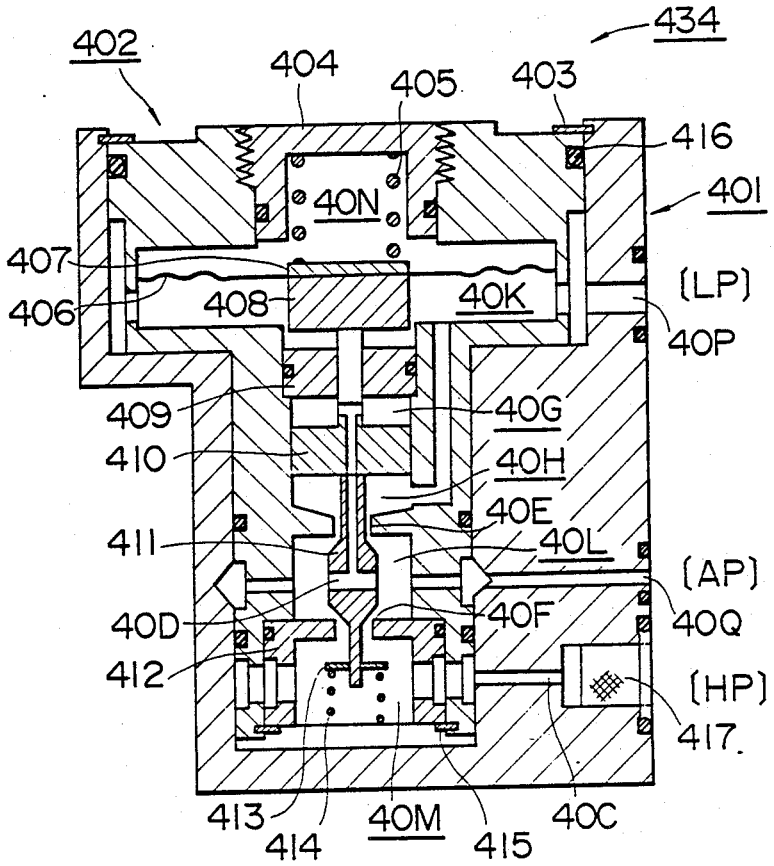
FIG. 1 is a longitudinal cross-sectional view showing a structure of a control valve according to an embodiment of the present invention.

FIG. 1 shows a structure of a control valve according to an embodiment of the present invention.

Figure 3A:
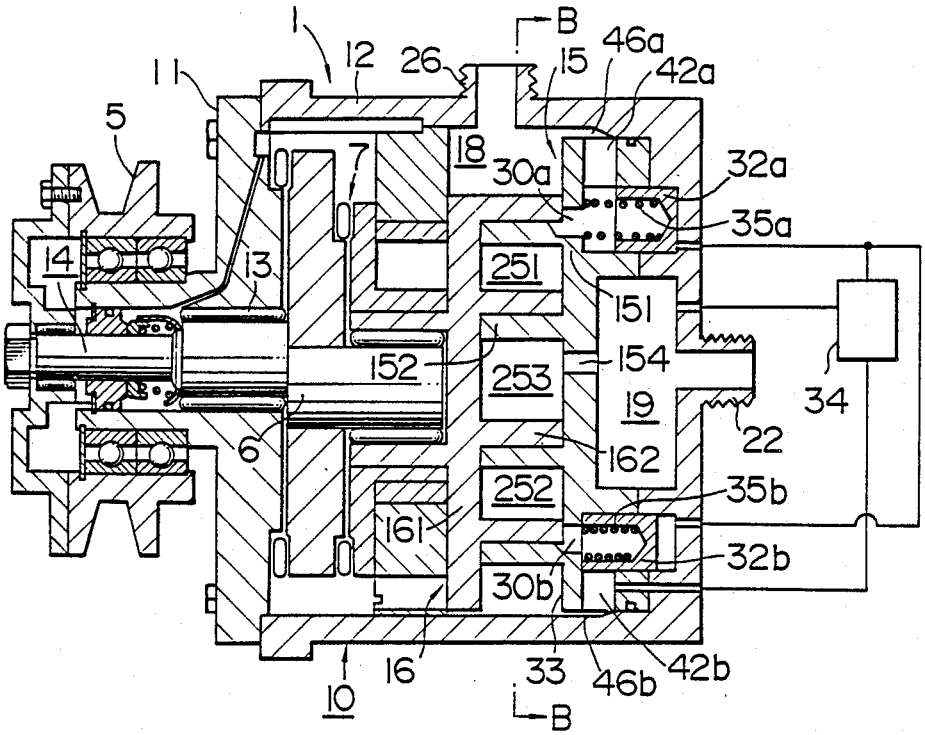
FIG. 3(A)(PRIOR ART)
Figure 3B:
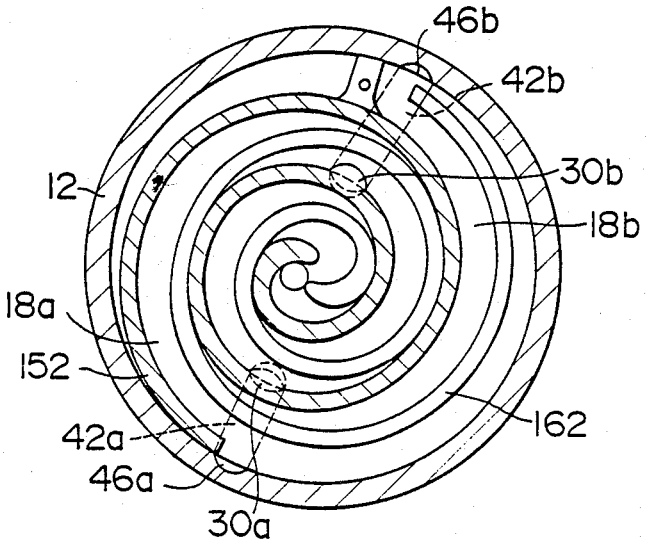
FIG. 3(B)(PRIOR ART)

A configuration of a capacity control device of a compressor according to the present invention is identical with that of FIG. 3 except a control valve 434 is shown in FIG. 1 and accordingly description other than the control valve 434 is omitted.

Figure 4:
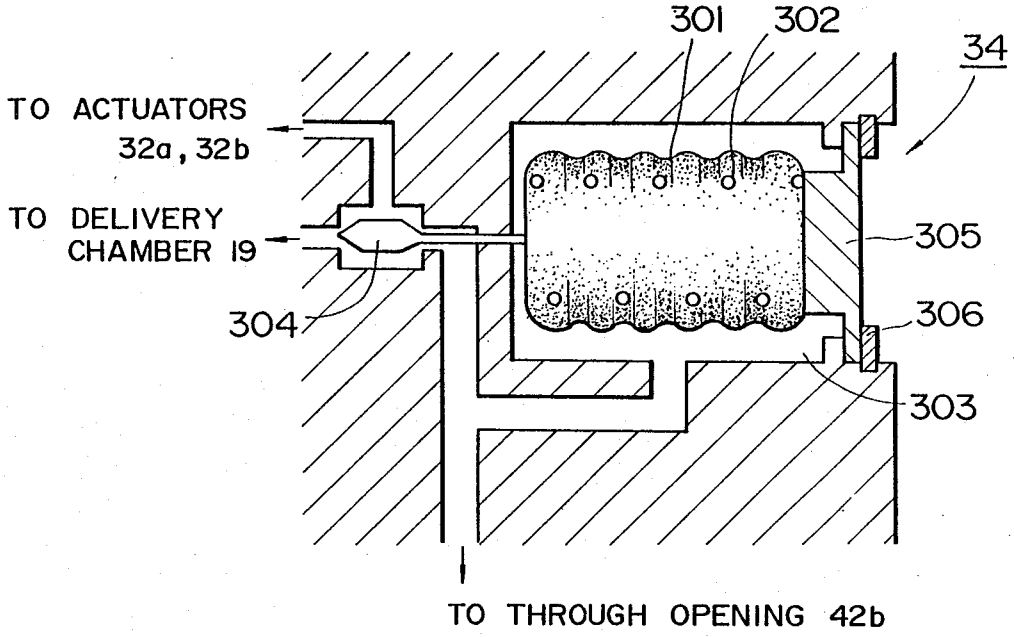
FIG. 4 (PRIOR ART)
FIG. 4 is a cross-sectional view of a part of a conventional control valve.
Figure 5:
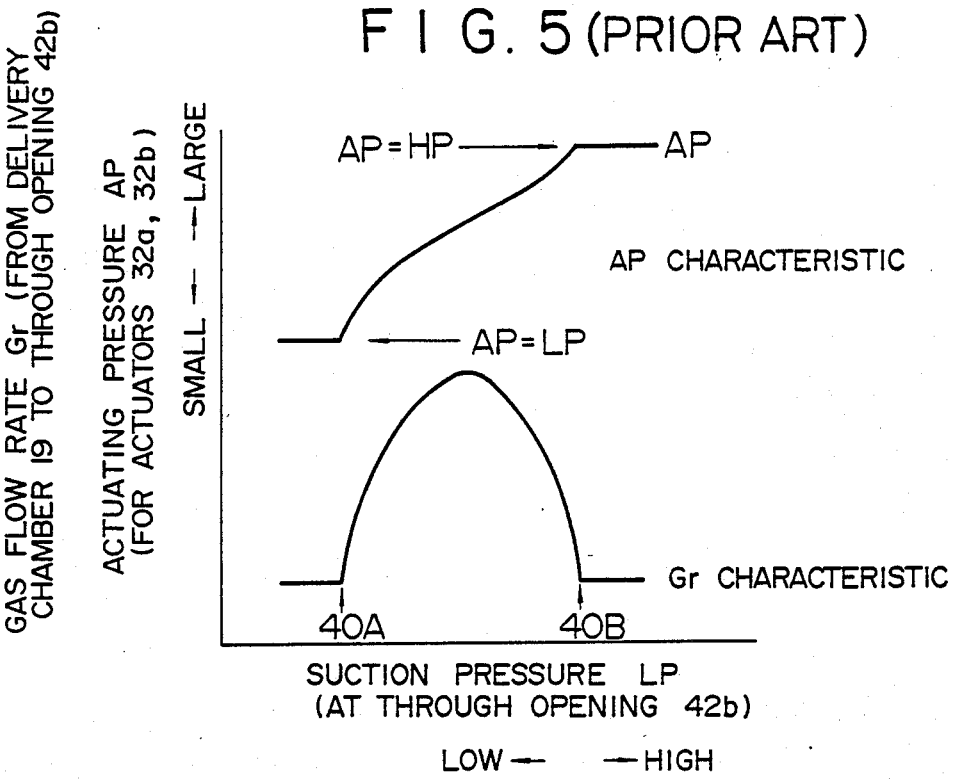
FIG. 5 (PRIOR ART)
FIG. 5 is a characteristic diagram showing the relation of an actuator and a gas pressure in a prior art arrangement.

The control valve 434 according to an embodiment of the present invention comprises a case 401 and a valve 402 as shown in FIG. 1. The valve 402 includes a diaphragm 406, straps 407 and 408, springs 405 and 414, an adjusting screw 404, a partition plate 409, a feedback piston 410, a valve body 411, a high-pressure side valve seat 412 and a spring stopper 413. An equalizer 40D connects between spaces 40L and 40G. Further, the case 401 is formed with a hole 40P which is connected to the through opening 42*b* shown in FIG. 4, a hole 40Q which is connected to the rear side of the actuators 32*a* and 32*b*, and a hole 40C which is connected to the delivery chamber 19. The valve 402 is fitted into the case 401 airtightly through an O-ring 416. The control valve of FIG. 1 uses other plural O-rings, as the function of the O-rings is just for sealing description thereof is omitted.

Further, numeral 403 and 415 denote stop rings, 417 a strainer, 40E and 40F valve seats, and 40H, 40K, 40M and 40N spaces.

Operation of the embodiment according to the present invention is now described.

Figure 2:
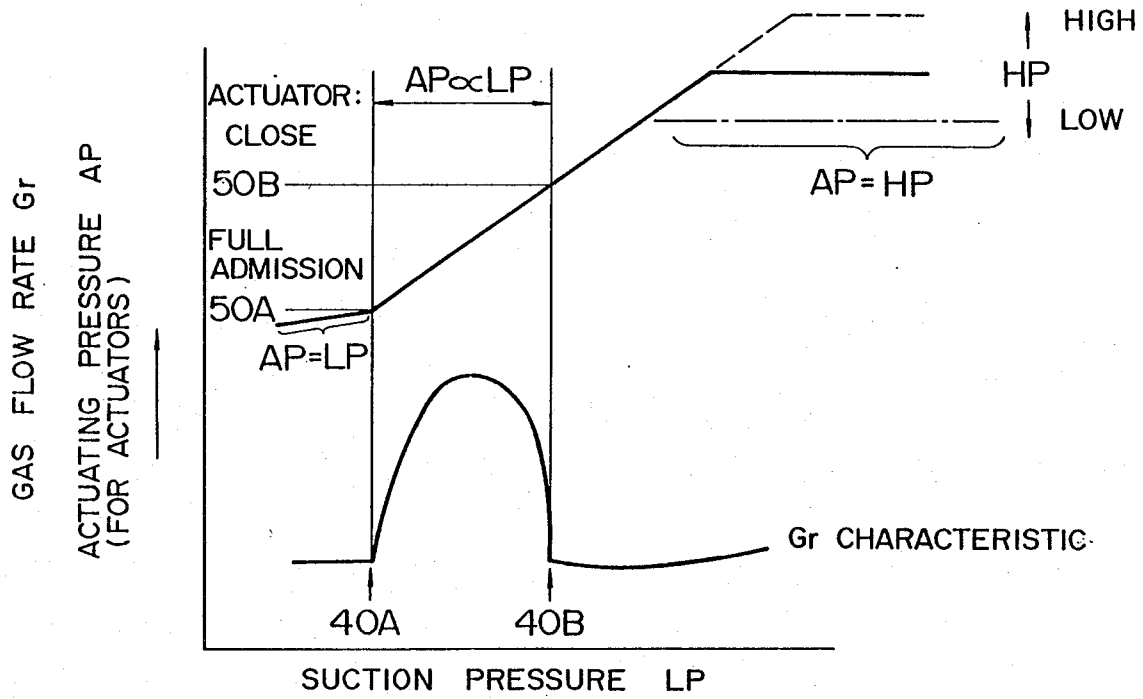
FIG. 2 is a characteristic diagram showing the relation of an actuator and a gas pressure in an embodiment of the present invention, FIGS. 3(A) and (B) are a longitudinal cross-sectional view showing a structure of a conventional scroll-type compressor having a capacity control mechanism and a cross-sectional view taken along line B—B of FIG. 3(A), respectively.
Figure 6:
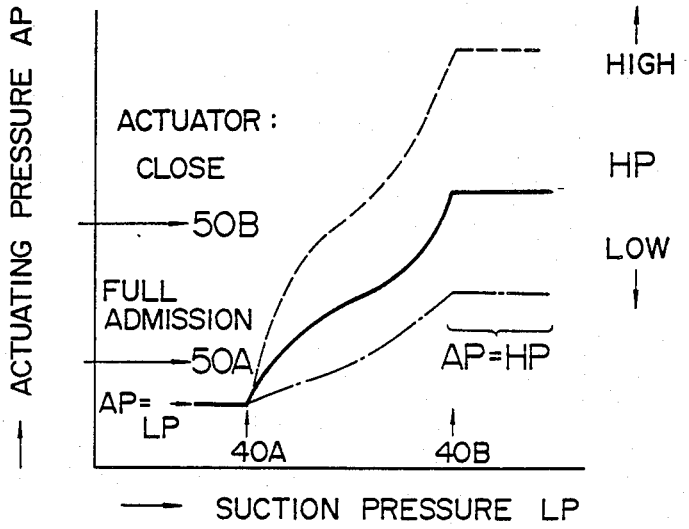
FIG. 6 (PRIOR ART)
FIG. 6 is a characteristic diagram showing performances of an actuator.

In FIG. 1, the atmospheric pressure is introduced in the space 40n, the suction pressure LP is introduced in the spaces 40K and 40H, the actuator actuating pressure AP is introduced in the spaces 40G and 40L, and the delivery pressure HP is introduced in the space 40M. If an effective area of the diaphragm 406 being acted on by pressure is SD, an effective area of the feedback piston 410 being acted on by pressure is SP, a cross-section of an upper stem of the feedback piston 410, areas of portions penetrating the valve seats 40E and 40F of the valve body 411, and areas of the valve seats 40E and 40F are sufficiently small as compared with the areas SD and SP, the relation of the AP and LP is generally given by $$AP = \frac{SD + SP}{SP} \times LP - \frac{F}{SP} \quad (1)$$

where F is a load by the springs 405 and 414. Actual variation of AP is shown in FIG. 2. When the LP increases to the point 40A shown in FIG. 6, the valve set 40F begins to open and the AP is increased. The valve seat 40E is substantially closed at the point 40B. As shown in FIG. 6, the point 50A is the fully opened or full admission point of the actuator and the point 50B is the fully closed point.

As apparent from the equation (1), according to the present invention, the LP and AP are expressed by an equation of the first degree (linear equation) and influence of the HP can be actually neglected by making small the areas of the valve seats 40E and 40F with respect to the area SD.

Accordingly, the position of the actuator can be determined by the suction pressure LP uniquely.

The suction pressure value can be controlled regardless of variation of the delivery output and the compressor itself advantageously possesses the frost control function which is attained by a suction pressure adjusting valve or the like in the prior art.

Further, the position of the actuators can be determined with respect to sudden variation of the LP without the feedback through the whole refrigerant system as in the prior art and accordingly high-speed response and stable control can be attained.

We claim:

1. A capacity control device of a scroll-type fluid compressor including a stationary spiral element and a revolving spiral element having a substantially identical configuration and fitted to each other, a center of the revolving spiral element being revolved in solar-orbital motion along a circumference around a center of the stationary spiral element so that fluid is sucked in at a suction location, compressed and delivered at a high pressure discharge; a fluid actuated actuator which controls an amount of fluid bypassed from a compression chamber formed between contacts of both the spiral elements into a suction chamber, feedback mechanism means connected to fluid at said suction location, connected to fluid at said high pressure discharge and connected to said actuator to provide actuating fluid, said feedback mechanism means for maintaining a relation between a suction pressure of fluid at said suction location and a pressure of the actuating fluid which is linear to control said actuator to maintain the suction substantially constant.

2. A capacity control device of a scroll-type fluid compressor according to claim 1, wherein said feedback mechanism comprises a diaphragm including one side to which resilience of a spring is applied and the other side to which the suction pressure is applied, feedback piston means coupled with said diaphragm through a stem, for applying a differential pressure, between the suction pressure and the actuating pressure of the actuator, to said diaphragm in a direction of application of the suction pressure, and three way type valve means for opening and closing a plurality of valve sets to continuously control the actuating pressure of the actuator from the suction pressure to a delivery pressure said three way type valve means including a valve body coupled with said piston.

3. A capacity control device of a scroll-type fluid compressor according to claim 2, wherein a cross-section of each of the stem, said feedback piston, a valve seat engaging member of the valve body and an area of the valve seat are sufficiently small as compared with effective area of said diaphragm and said feedback piston means.

4. A capacity control device of a scroll-type fluid compressor, the scroll-type fluid compressor including a suction location with fluid at a suction pressure, a discharge location with fluid at a discharge pressure and including bypass openings communicating with a compression chamber, fluid actuated actuator controlling the degree of opening of said bypass opening, said fluid actuated actuator being acted on by fluid at an actuating pressure, comprising: feedback means connected to fluid at said suction pressure and connected to fluid at said actuating pressure and connected to fluid at said discharge pressure for regulating the actuating pressure by supplying one of discharge pressure fluid, suction pressure fluid and a mix of discharge pressure and suction pressure fluid to said fluid actuated actuator for maintaining a linear relationship between the pressure of the suction fluid and the pressure of the actuating fluid.

5. A capacity control device for a scroll-type fluid compressor, comprising: a suction fluid connection connected to fluid at a suction pressure, a discharge fluid connection, connected to fluid at a discharge pressure; and an actuator connection connected to fliud at an actuating pressure; a three way valve connected to said suction connection, said discharge connection and to said actuating connection for connecting one of fluid at said suction pressure to said actuating connection and fluid at said discharge pressure to said actuating connection; and, feedback means for switching the connection of said three way valve to maintain a liner relationship between the suction pressure and the actuating pressure.

* * * * *